US005230749A

United States Patent [19]

Fujimura et al.

[11] Patent Number: 5,230,749

[45] Date of Patent: Jul. 27, 1993

[54] PERMANENT MAGNETS

[75] Inventors: Setsuo Fujimura, Kyoto; Masato Sagawa, Nagaokakyo; Yutaka Matsuura, Ibaraki; Hitoshi Yamamoto; Norio Togawa, both of Osaka, Japan

[73] Assignee: Sumitomo Special Metals Co., Ltd., Osaka, Japan

[21] Appl. No.: 728,037

[22] Filed: Jul. 8, 1991

Related U.S. Application Data

[60] Continuation of Ser. No. 349,765, May 10, 1989, abandoned, which is a division of Ser. No. 165,371, Feb. 29, 1988, Pat. No. 4,859,255, which is a continuation of Ser. No. 532,472, Sep. 15, 1983, abandoned.

[30] Foreign Application Priority Data

Aug. 4, 1983 [JP] Japan ..... 58-141850

[51] Int. Cl.[5] ..... H01F 1/02

[52] U.S. Cl. ..... 148/101; 148/102

[58] Field of Search ..... 148/101, 102, 103, 302; 420/83, 121

[56] References Cited

U.S. PATENT DOCUMENTS

| | | | |
|---|---|---|---|
| 4,210,471 | 7/1980 | Yoneyama et al. | 148/102 |
| 4,402,770 | 9/1983 | Koon | 148/302 |
| 4,802,931 | 2/1989 | Croat | 148/302 |
| 4,851,058 | 7/1989 | Croat | 148/102 |
| 4,859,255 | 8/1989 | Fujimura et al. | 148/302 |

FOREIGN PATENT DOCUMENTS

| | | |
|---|---|---|
| 52-50598 | 4/1977 | Japan . |
| 57-141901 | 9/1982 | Japan . |
| 2021147 | 11/1979 | United Kingdom . |

OTHER PUBLICATIONS

Handrich et al., "Amorphe Ferro und Ferrimagnetika" Berlin 1980 pp. 82 to 85.

G. C. Hadjipanayis et al., "New Iron-Rare-Earth Based Permanent Magnet Materials", Appl. Phys. Lett., 43(8), pp. 797-799, Oct. 15, 1983.

H. H. Stadelmaier et al. "Cobalt-Free and Samarium--Free Permanent Magnet Materials Based on an Iron--Rare Earth Boride", Materials Letters, vol. 2, No. 2, pp. 169-172, Oct. 1983.

G. C. Hadjipanaysis et al., "Electronic and Magentic Properties of Rare-Earth-Transition Metal Glasses", Journal of Magnetism and Magentic Materials, vol. 21, pp. 101-107, Sep. 27, 1979.

F. E. Luborsky et al., "Magnetic Anneal Anisotropy in Amorphous Alloys", IEEE Transactions on Magnetics, vol. MAG—13, No. 2, pp. 953-956, Mar. 1977.

*Primary Examiner*—John P. Sheehan

*Attorney, Agent, or Firm*—Fish & Richardson

[57] ABSTRACT

A magnetically anisotropic sintered permanent magnet of the FeCoBR system (R is sum of $R_1$ and $R_2$) wherein:

$R_1$ is Dy, Tb, Gd, Ho, Er, Tm and/or Yb, and $R_2$ comprises 80 at % or more of Nd and Pr in $R_2$, and the balance of other rare earth elements exclusive of $R_1$, said system consisting essentially of, by atomic percent, 0.05 to 5% of $R_1$, 12.5 to 20% of R, 4 to 20% of B up to 35% of Co, and the balance being Fe. Additional elements M(Ti, Zr, Hf, Cr, Mn, Ni, Ta, Ge, Sn, Sb, Bi, Mo, Nb, Al, V, W) may be present.

6 Claims, 3 Drawing Sheets

1. Fe - 8B - 15Nd TABLE 1 No. #1
2. Fe - 20Co - 8B - 13.2Nd - 0.8Dy TABLE 1 - No.8
3. Fe - 10Co - 7B - 13.5Nd - 1.5Dy - 1Nb TABLE 3 No 1

PERMANENT MAGNETS

This application is a continuation of application Ser. No. 349,765, filed May 10, 1989 and now abandoned; which in turn is a divisional of application Ser. No. 165,371, file Feb. 29, 1988 now U.S. Pat. No. 4,859,255; which in turn is a continuation of application Ser. No. 532,472, filed Sep. 15, 1983 and now abandoned.

FIELD OF THE INVENTION AND BACKGROUND

The present invention relates to high-performance permanent magnet materials based on rare earth elements and iron, which make it possible to reduce the amount of Co that is rare and expensive.

Magnetic materials and permanent magnets are one of the important electric and electronic materials applied in an extensive range from various electrical appliances for domestic use to peripheral terminal devices of large-scaled computers. In view of recent needs for miniaturization and high efficiency of electric and electronic equipment, there has been an increasing demand for upgrading of permanent magnets and in general magnetic materials.

Now, referring to the permanent magnets, typical permanent magnet materials currently in use are alnico, hard ferrite and rare earth-cobalt magnets. With a recent unstable supply of cobalt, there has been a decreasing demand for alnico magnets containing 20–30 wt % of cobalt. Instead, inexpensive hard ferrite containing iron oxides as the main component has showed up as major magnet materials. Rare earth-cobalt magnets are very expensive, since they contain 50–65 wt % of cobalt and make use of Sm that is not much found in rare earth ores. However, such magnets have often been used primarily for miniaturized magnetic circuits of high added value, because they are by much superior to other magnets in magnetic properties.

In order to make it possible to inexpensively and abundantly use high-performance magnets such as rare earth-cobalt magnets in wider fields, it is required that one does not substantially rely upon expensive cobalt, and uses mainly as rare earth metals light rare earth elements such as neodymium and praseodymium which occur abundantly in ores.

In an effort to obtain permanent magnets as an alternative to such rare earth-cobalt magnets, studies have first been made of binary compounds based on rare earth elements and iron.

Existing compounds based on rare earth elements and iron are limited in number and kind compared with the compounds based on rare earth elements and cobalt, and are generally low in Curie temperature point point. For that reason, any attempts have resulted in failure to obtain magnets from the compounds based on rare earth elements and iron by casting or powder metallurgical technique used for the preparation of magnets from the compounds based on rare earth elements and cobalt.

A. E. Clark discovered that sputteréd amorphous $TbFe_2$ had a coercive force, Hc, of as high as 30 kOe at 4.2° K, and showed Hc of 3.4 kOe and a maximum energy product, (BH)max, of 7 MGOe at room temperature upon heat-treated at 300° to 350° C. (Appl. Phys. Lett. 23(11), 1973, 642–645).

J. J. Croat et al have reported that Hc of 7.5 kOe is obtained with the melt-quenched ribbons of NdFe and PrFe wherein light rare earth elements Nd and Pr are used. However, such ribbons show Br of 5 kG or below and (BH)max of barely 3–4 MGOe (Appl. Phys. Lett. 37, 1980, 1096; J. Appl. Phys. 53, (3) 1982, 2404–2406).

Thus, two manners, one for heat-treating the previously prepared amorphous mass and the other for melt-quenching it, have been known as the most promising means for the preparation of magnets based on rare earth elements and iron.

However, the materials obtained by these method are in the form of thin films or strips so that they cannot be used as the magnet materials for ordinary electric circuits such as loud speakers or motors.

Furthermore, N. C. Koon et al discovered that Hc of 9 kOe was reached upon heat treated (Br=5 kG) with melt-quenched ribbons of heavy rare earth element-containing FeB base alloys to which La was added, say, $(Fe_{0.82}B_{0.18})_{0.9}Tb_{0.05}La_{0.05}$ (Appl. Phys. Lett. 39(10), 1981, 840–842).

In view of the fact that certain FeB base alloys are made easily amorphous, L. Kabacoff et al prepared the melt-quenched ribbons of $(Fe_{0.8}B_{0.2})_{1-x}Pr_x$ (x=0–0.3 in atomic ratio), but they showed Hc of only several Oe at room temperature (J. Appl. Phys. 53(3) 1982, 2255–2257).

The magnets obtained from such sputtered amorphous thin film or melt-quenched ribbons are thin and suffer limitations in view of size, and do not provide practical permanent magnets which can be used as such for general magnetic circuits. In other words, it is impossible to obtain bulk permanent magnets of any desired shape and size such as the prior art ferrite and rare earth-cobalt magnets. Since both the sputtered thin films and the melt-quenched ribbons are magnetically isotropic by nature, it is indeed almost impossible to obtain therefrom magnetically anisotropic permanent magnets of high performance.

Recently, the permanent magnets have increasingly been exposed to even severer circumstances—strong demagnetizing fields incidental to the thinning tendencies of magnets, strong inverted magnetic fields applied through coils or other magnets, high processing rates of current equipment, and high temperatures incidental to high loading—and, in many applications, now need possess a much higher coercive force for the stabilization of their properties. It is generally noted in this connection that the iHc of permanent magnets decreases with increases in temperature. For that reason, they will be demagnetized upon exposure to high temperatures, if their iHc is low at room temperature. However, if iHc is sufficiently high at room temperature, such demagnetization will then not substantially occur.

Ferrite or rare earth-cobalt magnets make use of additive elements or varied composition systems to obtain a high coercive force; however, there are generally drops of saturation magnetization and (BH)max.

SUMMARY OF THE DISCLOSURE

An essential object of the present invention is to provide novel permanent magnets and magnet materials, from which the disadvantages of the prior art are substantially eliminated.

As a result of studies made of a number of systems for the purpose of preparing compound magnets based on R-Fe binary systems, which have a high Curie point and are stable at room temperature, it has already been found that FeBR and FeBRM base compounds are especially suited for the formation of magnets (U. S. patent application Ser. No. 510,234 filed on Jul. 1, 1983).

A symbol R is here understood to indicate at least one of rare earth elements inclusive of Y and, preferably, refer to light rare earth elements such as Nd and Pr. B denotes boron, and M stands for at least one element selected from the group consisting of Al, Ti, V, Cr, Mn, Zr, Hf, Nb, Ta, Mo, Ge, Sb, Sn, Bi, Ni and W.

The FeBR magnets have a practically sufficient Curie point of as high as 300° C. or more. In addition, these magnets can be prepared by the powder metallurgical procedures that are alike applied to ferrite or rare earth-cobalt systems, but not successfully employed for R-Fe binary systems.

The FeBR base magnets can mainly use as R relatively abundant light rare earth elements such as Nd and Pr, do not necessarily contain expensive Co or Sm, and can show (BH)max of as high as 36 MGOe or more that exceeds largely the highest (BH)max value (31 MGOe) of the prior art rare earth-cobalt magnets.

It has further been found that the magnets based on these FeBR and FeBRM system compounds exhibit crystalline X-ray diffraction patterns that are sharply distinguished over those of the conventional amorphous strips or melt-quenched ribbons, and contain as the major phase a novel crystalline structure of the tetragonal system (U. S. patent application Ser. No. 510,234 filed on Jul. 1, 1983).

In general, these FeBR and FeBRM base alloys have a Curie point ranging from about 300° C. to 370° C., and higher Curie points are obtained with permanent magnets prepared by substituting 50 at % or less of Co for the Fe of such system. Such FeCoBR and FeCoBRM base magnets are disclosed in U. S. patent application Ser. No. 516,841 filed on Jul. 25, 1983.

More specifically, the present invention has for its object to increase the thermal properties, particularly iHc while retaining a maximum energy product, (BH)max, which is identical with, or larger than, that obtained with the aforesaid FeCoBR and FeCoBRM base magnets.

According to the present invention, it is possible to markedly increase the iHc of FeCoBR (Fe, Co)—B—R) and FeCoBRM (or (Fe, Co)—B—R—M) base magnets wherein as R light rare earth elements such as Nd and Pr are mainly used, while maintaining the (BH)max thereof at a high level, by incorporating thereto $R_1$ forming part of R, said $R_1$ representing at least one of rare earth elements selected from the group consisting of Dy, Tb, Gd, Ho, Er, Tm and Yb. Namely $R_1$ is mainly comprised of heavy rare earth elements.

That is to say, the permanent magnets according to the present invention are as follows.

Magnetically anisotropic sintered permanent magnets are comprised of the FeCoBR system in which R represents the sum of $R_1$ and $R_2$ wherein:

$R_1$ is at least one of rare earth elements selected from the group consisting of Dy, Tb, Gd, Ho, Er, Tm and Yb, and $R_2$ includes a total of 80 at % or more of Nd and Pr relative to the entire $R_2$, and contains at least one of other rare earth elements exclusive of $R_1$ but inclusive of Y, said system consisting essentially of, by atomic percent, 0.05 to 5% of $R_1$, 12.5 to 20% of R, 4 to 20% of B, O (exclusive) to 35% of Co and the balance being Fe with impurities.

The other aspect of the present invention provides an anisotropic sintered permanent magnet of the FeCoBRM system.

DETAILED DESCRIPTION OF THE PREFERRED EMBODIMENTS

Figure 1:
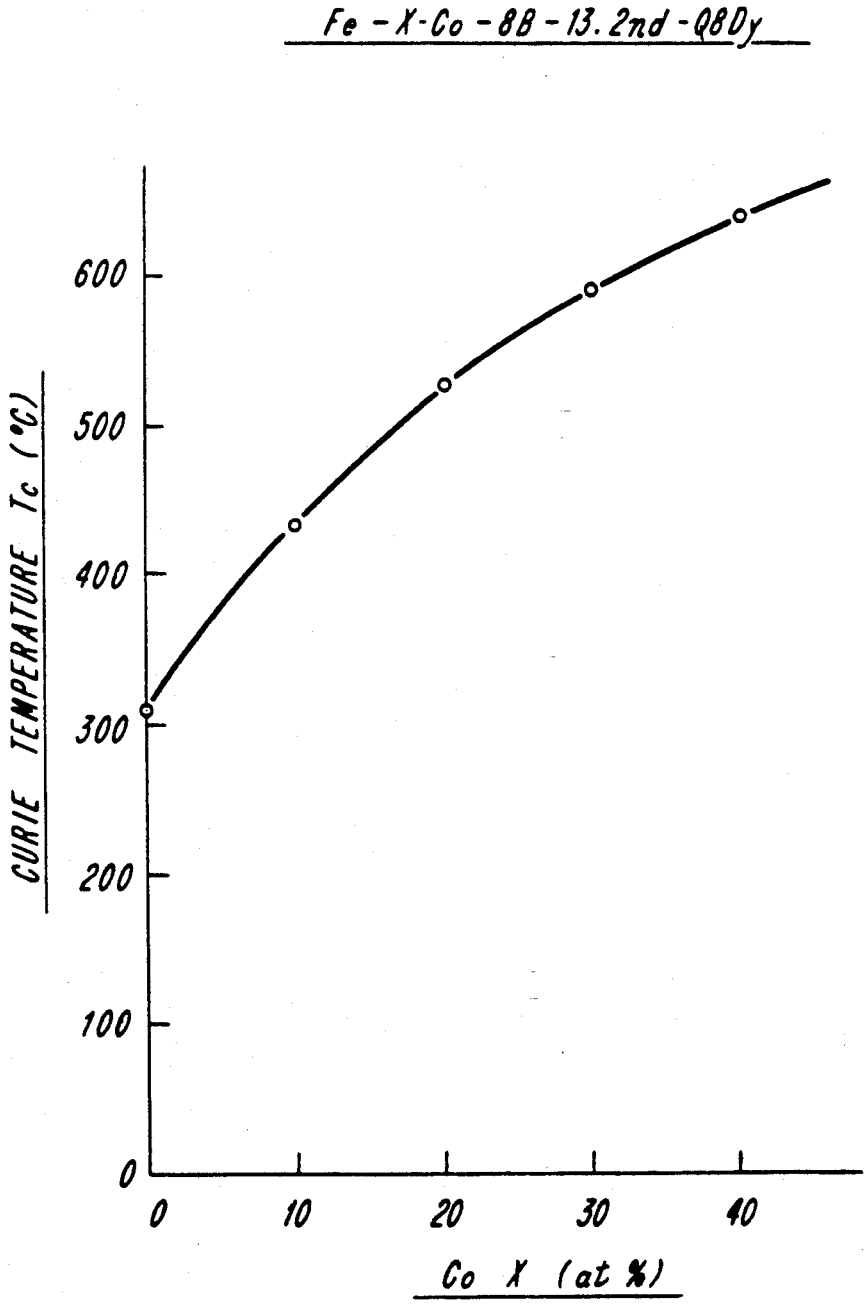
FIG. 1 is a graph showing the relationship between the amount of Co and the Curie point, Tc, in one example of the present invention wherein Fe is substituted with Co.

In the present disclosure % denotes atomic percent if not otherwise specified.

Magnetically anisotropic sintered permanent magnets comprise FeCoBRM systems in which R represents the sum of $R_1$ and $R_2$, and M represents one or more additional elements added in amounts no more than the values as specified below wherein:

$R_1$ is at least one of rare earth elements selected from the group consisting of Dy, Tb, Gd, Ho, Er, Tm and Yb, $R_2$ includes a total of 80 at % relative to the entire $R_2$ or more of Nd and Pr and contains at least one of light rare earth elements exclusive of $R_1$ but inclusive of Y, and M is

| | | | | | |
|---|---|---|---|---|---|
| 3% | Ti, | 3.3% | Zr, | 3.3% | Hf, |
| 4.5% | Cr, | 5% | Mn, | 6% | Ni, |
| 7% | Ta. | 3.5% | Ge, | 1.5% | Sn, |
| 1% | Sb, | 5% | Bi, | 5.2% | Mo, |
| 9% | Nb, | 5% | Al, | 5.5% | V, |
| and 5% W, | | | | | |

said system essentially consisting of, by atomic percent, 0.05 to 5% of $R_1$, 12.5 to 20% of R, 4 to 20% of B, O (exclusive) to 35% (inclusive) of Co and the balance being Fe with impurities, provided that, when two or more additional elements M are included, the sum of M should be no more than the maximum value among those specified above of said elements M actually added.

It is noted that the allowable limits of typical impurities to be included in the end products should be no higher than the following values by atomic percent:

| | | | | | |
|---|---|---|---|---|---|
| 2% | Cu, | 2% | C, | 2% | P, |
| 4% | Ca, | 4% | Mg, | 2% | O, |
| 5% | Si, and | 2% | S. | | |

It is noted, however, that the sum of impurities should be no more than 5%.

Such impurities are expected to be originally present in the starting material, or to come from the process of production, and the inclusion thereof in amounts exceeding the aforesaid limits would result in deterioration of properties. Among these impurities, Si serves both to increase Curie points and to improve corrosion resistance, but incurs decreases in iHc in an amount exceeding 5%. Ca and Mg may abundantly be contained in the R raw material, and has an effect upon increases in iHc. However, it is unpreferable to use Ca and Mg in larger amounts, since they deteriorate the corrosion resistance of the end products.

Having the composition as mentioned above, the permanent magnets show a coercive force, iHc, of as high as 10 kOe or more, while they retain a maximum energy product, (BH)max, of 20 MGOe or more.

The present invention will now be explained in detail.

As mentioned above, the FeBR base magnets possess high (BH)max, but their iHc was only similar to that of the $Sm_2Co_{17}$ type magnet which was typical one of the conventional high-performance magnets (5 to 10 kOe). This proves that the FeBR magnets are easily demagnetized upon exposure to strong demagnetizing fields or high temperatures. The iHc of magnets generally decreases with increases in temperature. For instance, the $Sm_2Co_{17}$ type magnets or the FeBR base magnets have a coercive force of barely 5 kOe at 100° C. (see Table 4).

Any magnets having such iHc cannot be used for magnetic disc actuators for computers or automobile motors, since they tend to be exposed to strong demagnetizing fields or high temperatures. To obtain even higher stability at elevated temperatures, it is required to increase Curie points and increase further iHc at temperatures near room temperature.

It is generally known that magnets having higher iHc are more stable even at temperatures near room temperature against deterioration with the lapse of time (changes with time) and physical disturbances such as impacting and contacting.

Based on the above-mentioned knowledge, further detailed studies were mainly focused on the FeCoBR componental systems. As a result, it has been found that a combination of at least one of rare earth elements Dy, Tb, Gd, Ho, Er, Tm and Yb with light rare earth elements such as Nd and Pr can provide a high coercive force that cannot possibly be obtained with the FeCoBR and FeCoBRM base magnets.

Furthermore, the componental systems according to the present invention have an effect upon not only increases in iHc but also improvements in the loop squareness of demagnetization curves, i.e., further increases in (BH)max. Various studies made to increase the iHc of the FeCoBR base magnets have revealed that the following procedures are effective.

(1) Increasing the amount of R or B, and (2) adding additional element(s) M.

However, it is recognized that increasing the amount of R or B serves to enhance iHc, but, as that amount increases, Br decreases with the values of (BH)max decreasing as a result.

It is also true that the additional element(s) M is effective to increase iHc, but, as the amount of M increases, (BH)max drops again, thus not giving rise to any noticeable improvements.

In accordance with the permanent magnets of the present invention, an increase in iHc by aging is remarkable owing to the inclusion of $R_1$ that is rare earth elements, especially heavy rare earth elements, the main use of Nd and Pr as $R_2$, and the specific composition of R, B and Co. It is thus possible to increase iHc without having an adverse influence upon the value of Br by aging the magnetically anisotropic sintered bodies comprising alloys having the specific composition as mentioned above. Besides, the loop squareness of demagnetization curves is improved, while (BH)max is maintained at the same or higher level. It is noted in this connection that, when the composition of R, B and Co and the amount of Nd plus Pr are within the specified ranges, iHc of about 10 kOe or higher is already reached prior to aging. Post-aging thus gives rise to a more favorable effect in combination with the incorporation of a given amount of $R_1$ into R.

That is to say, the present invention provides high-performance magnets which, while retaining (BH)max of 20 MGOe or higher, combines Tc of about 310° to about 640° C. with sufficient stability to be expressed in terms of iHc of 10 kOe or higher, and can find use in applications wider than those in which the conventional high-performance magnets have found use.

The maximum values of (BH)max and iHc are 37.2 MGOe (see No. 3 in Table 2 given later) and 16.8 kOe (see No. 7 in Table 2), respectively.

In the permanent magnets according to the present invention, R represents the sum of $R_1$ and $R_2$, and encompasses Y as well as rare earth elements Nd, Pr, La, Ce, Tb, Dy, Ho, Er, Eu, Sm, Gd, Pm, Tm, Yb and Lu. Out of these rare earth elements, at least one of seven elements Dy, Tb, Gd, Ho, Er, Tm and Yb is used as $R_1$. $R_2$ represents rare earth elements except the above-mentioned seven elements and, especially, includes a sum of 80 at % or more of Nd and Pr in the entire $R_2$, Nd and/or Pr being light rare earth elements.

The rare earth elements used as R may or may not be pure, and those containing impurities entrained inevitably in the process of production (other rare earth elements, Ca, Mg, Fe, Ti, C, O, S and so on) may be used alike, as long as one has commercially access thereto. Also alloys of those rare earth elements with other componental elements such as Nd-Fe alloy, Pr-Fe alloy, Dy-Co alloy, Dy-Fe alloy or the like may be used.

As boron (B), pure- or ferro-boron may be used, including those containing as impurities Al, Si, C and so on.

When composed of 0.05–5 at % $R_1$, 12.5–20 at % R representing the sum of $R_1+R_2$, 4–20 at % B, O (exclusive)–35 at % (inclusive) Co and the balance being Fe, the permanent magnets according to the present invention show a high coercive force (iHc) on the order of n less than about 10 kOe, a high maximum energy product ((BH)max) on the order of no less than 20 MGOe and a residual magnetic flux density (Br) on the order of no less than 9 kG.

The composition of 0.2–3 at % $R_1$, 13–19 at % R, 5–11 at % B, O (exclusive)–23 at % (inclusive) Co and the balance being Fe are preferable in that they show (BH)max of 29 MGOe or more.

As $R_1$ particular preference is given to Dy and Tb.

The reason for placing the lower limit of R upon 12.5 at % is that, when the amount of R is below that limit, Fe precipitates from the alloy compounds based on the present systems, and causes a sharp drop of coercive force. The reason for placing the upper limit of R upon 20 at % is that, although a coercive force of no less than 10 kOe is obtained even in an amount exceeding 20 at %, yet Br drops to such a degree that the required (BH)max of no less than 20 MGOe is not attained.

Referring now to the amount of $R_1$ forming part of R, Hc increases even by the substitution of barely 0.2% for R, as will be understood from No.2 in Table 2. The loop squareness of demagnetization curves is also improved with increases in (BH)max. The lower limit of $R_1$ is placed upon 0.05 at %, taking into account the effects upon increases in both iHc and (BH)max (see FIG. 2). As the amount of $R_1$ increases, iHc increases (Nos. 2 to 7 in Table 2), and (BH)max decreases bit by bit after showing a peak at 0.4 at %. However, for example, even 3 at % addition gives (BH)max of 29 MGOe or higher (see FIG. 2).

In applications for which stability is especially needed, the higher the iHc, say, the more the amount of $R_1$, the better the results will be. However, the elements constituting $R_1$ are contained in rare earth ores to only a slight extent, and are very expensive. This is the reason why the upper limit of $R_1$ is fixed at 5 at %. When the amount of B is 4 at % or less, iHc decreases to 10 kOe or less. Like R, B serves to increase iHc, as its amount increases, but there is a drop of Br. To give (BH)max of 20 MGOe or more the amount of B should be no more than 20 at %.

Because of the inclusion of Co in an amount of no more than 35 at %, the permanent magnets of the present invention have improved temperature-depending properties while maintaining (BH)max at a high level. It is generally observed that, as the amount of Co incorporated in Fe-alloys increases, some Fe alloys increase proportionally in Curie point, while another decrease in that point. Difficulty is thus involved in the anticipation of the effect created by Co addition.

When the Fe of FeBR systems is partially substituted with Co, the Curie point increases gradually with increases in the amount of Co added, as will be appreciated from FIG. 1. Co is effective for an increase in Curie point even in a slight amount of, e.g., 1 at %, and gives alloys having any Curie point which ranges from about 310° to about 640° C. depending upon the amount to be added. When Fe is substituted with Co, iHc tends to drop with increases in the amount of Co, but (BH)max increases slightly at the outset due to the improved loop rectangularity of demagnetization curves.

When the amount of Co is 25 at % or below, it contributes to an increase in Curie point without having substantial influence upon other magnetic properties, particularly (BH)max. Especially, Co serves to maintain said other magnetic properties at the same or higher level in amounts of 23 at % or below.

When the amount of Co exceeds 25 at %, there is a drop of (BH)max. When the amount of Co increases to 35 at % or higher, (BH)max decreases to 20 MGOe or below. The incorporation of Co in an amount of 5 at % or more also causes the coefficient of temperature dependence of Br(referred to as the thermal coefficient of Br) to be on the order of about 0.1%/°C. or less.

The FeCoBR base magnets of the present invention were magnetized at normal temperature, and exposed to an atmosphere of 100° C. to determine their irreversible loss of magnetic flux which was found to be only slight compared with that of the $Sm_2Co_{17}$ magnets or the FeCo magnet free from $R_1$. This indicates that stability is considerably improved.

As far as Co is concerned, parallel discussions hold for the FeCoBRM systems, and as far as an increase in Curie point is concerned, similar tendencies are essentially observed, although that increase varies more or less depending upon the type of M.

The additional element(s) M serves to increase iHc and improve the loop squareness of demagnetization. However, as the amount of M increases, Br deceases. Br of 9 kG or more is thus needed to obtain (BH)max of 20 MGOe or more. This is the reason why the upper limits of M to be added are fixed as mentioned in the foregoing. When two or more additional elements M are included, the sum of M should be no more than the maximum value among those specified in the foregoing of said elements M actually added. For instance, when Ti, Ni and Nb are added, the sum of these elements is no more than 9 at %, the upper limit of Nb. Preferable as M are V, Nb, Ta, Mo, W, Cr and Al. It is noted that, except some M such as Sb or Sn, the amount of M is preferably within about 2 at %.

The permanent magnets of the present invention are obtained as sintered bodies. It is then important that the sintered bodies, either based on FeCoBR or FeCoBRM, have a mean crystal grain size of 1 to 100 microns, preferably 2 to 40 microns more preferably about 3 to 10 microns. Sintering can be carried out at temperature of 900° to 1200° C. Aging following sintering can be carried out at a temperature between 350° C. and the sintering temperature, preferably between 450° and 800° C. The alloy powders for sintering have appropriately a mean particle size of 0.3 to 80 microns, preferably 1 to 40 microns, more preferably 2–20 microns. Sintering conditions, etc. are disclosed in a parallel U. S. patent application to be assigned to the same assignee with this application based on Japanese Patent Application Nos. 58-88373 and 58-90039.

The embodiments and effects of the present invention will now be explained with reference to examples, which are given for the purpose of illustration alone, and are not intended to limit the scope of the present invention.

Samples were prepared by the following steps (purity is given by weight).

(1) Alloys were melted by high-frequency melting and cast in a water-cooled copper mold. As the starting materials for Fe, B and R use was made of 99.9% electrolytic iron, ferroboron alloys of 19.38% B, 5.32% Al, 0.74% Si, 0.03% C and the balance Fe, and a rare earth element or elements having a purity of 99.7% or higher with the impurities being mainly other rare earth elements, respectively.

(2) Pulverization: The castings were coarsely ground in a stamp will until they passed through a −35-mesh sieve, and then finely pulverized in a ball mill for 3 hours to 3–10 microns.

(3) The resultant powders were aligned in a magnetic field of 10 kOe and compacted under a pressure of 1.5 $t/cm^2$.

(4) The resultant compacts were sintered at 1000°–1200° C. for one hour in an argon atmosphere and, thereafter, allowed to cool.

The samples were processed, polished, and tested to determine their magnetic properties in accordance with the procedures for measuring the magnetic properties of electromagnets.

EXAMPLE 1

Prepared were alloys containing as R a number of combinations of Nd with other rare earth elements, from which magnets were obtained by the above-mentioned steps. The results are shown in Table 1. It has been found that, among the rare earth elements R, there are certain elements $R_1$ such as Dy, Tb, Ho and so on, which have a marked effect on improvements in iHc, as seen from Nos. 11 to 14. Comparison examples are marked. It has also been recognized from Table 1 that the coefficient of temperature dependence of Br is decreased to 0.01%/°C. or below by the inclusion of Co in an amount of 5 at % or higher.

EXAMPLE 2

In accordance with the foregoing procedures, magnets were obtained using light rare earth elements, mainly Nd and Pr, in combination with the rare earth elements, which were chosen in a wider select than as mentioned in Example 1 and applied in considerably varied amounts. To increase further iHc, heat treatment was applied at 600° to 700° C. for two hours in an argon atmosphere. The results are set forth in Table 2.

In table 2, No. *1 is a comparison example wherein only Nd was used as the rare earth element. Nos. 2 to 7 are examples wherein Dy was replaced for Nd. iHc increases gradually with increases in the amount of Dy, and (BH) max reaches a maximum value when the amount of Dy is about 0.4 at %. See also FIG. 2.

Figure 2:
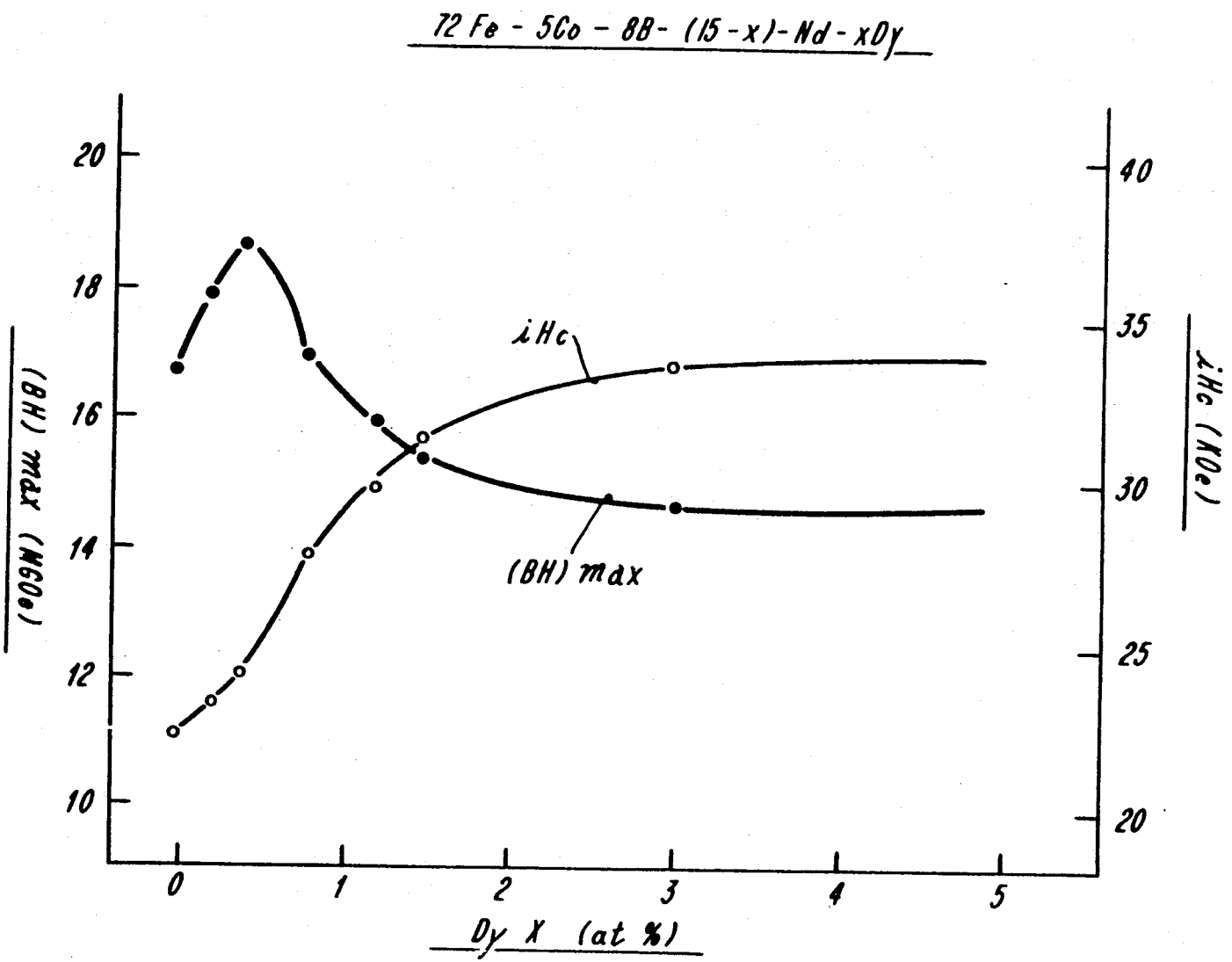
FIG. 2 is a graph showing the relationship between the amount of Dy, and iHc and (BH)max in one example of the present invention wherein Nd is substituted with Dy, one element represented by $R_1$.

FIG. 2 indicates that Dy begins to affect iHc from 0.05 at %, and enhance its effect from 0.1 to 0.3 at % (this will become apparent if the abscissa of FIG. 2 is rewritten in terms of a logarithmic scale). Although Gd(No. 11), Ho(No. 10), Tb(No. 12), Er(No. 13), Yb(No. 14), etc. have a similar effect, yet a considerably large effect on increases in iHc is obtained with Dy and Tb. The elements represented by $R_1$, other than Dy and Tb, also give iHc exceeding largely 10 kOe and high (BH)max. Any magnets materials having (BH)max of as high as 30 MGOe or higher which can provide such a high iHc have not been found until now. (BH)max of 20 MGOe or more is also obtained by replacing Pr for Nd (No. 15), or allowing (Nd plus Pr) to amount to 80% or more of $R_2$.

Figure 3:
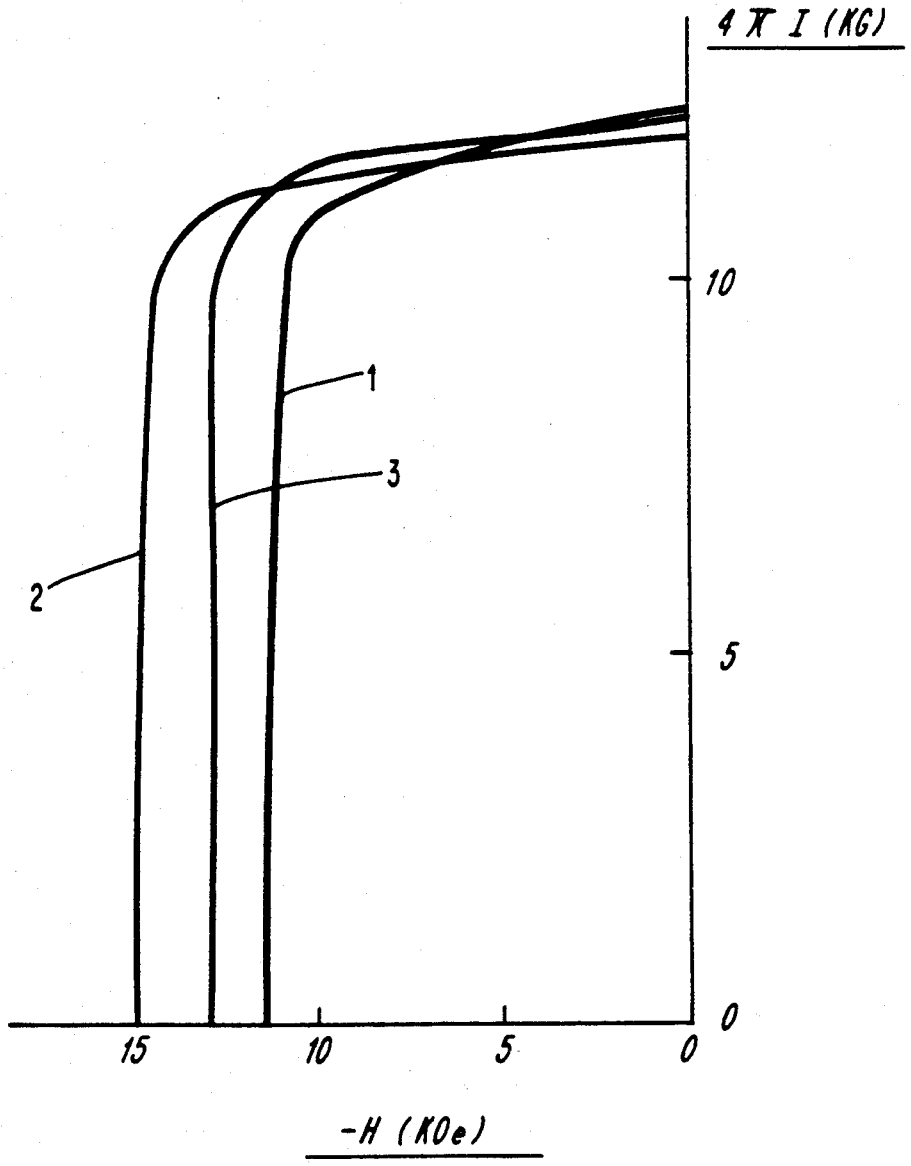
FIG. 3 is a graph showing the demagnetization curves of typical example of the present invention.

FIG. 3 shows a demagnetization curve of 0.8% Dy (No. 8 in Table 1) having typical iHc, from which it is recognized that iHc is sufficiently high compared with that of the Fe-B-Nd base sample (No. 1 in Table 1).

EXAMPLE 3

As the additional elements M use was made of Ti, Mo, Bi, Mn, Sb, Ni, Ta, Sn and Ge, each having a purity of 99%, W having a purity of 98%, Al having a purity of 99.9%, Hf having a purity of 95%, ferrovandium (serving as V) containing 81.2% of V, ferroniobium (serving as Nb) containing 67.6% of Nb, ferrochromium (serving as Cr) containing 61.9% of Cr and ferrozirconium (serving as Zr) containing 75.5% of Zr, wherein the purity is given by weight percent.

The starting materials were alloyed and sintered in accordance with the foregoing procedures, followed by aging at 500°-700° C. The results are shown in Table 3.

It has been ascertained that the FeCoBRM base alloys prepared by adding the additional elements M to the FeCoBR base systems have also sufficiently high iHc. A demagnetization curve of No. 1 in Table 3 is shown as a curve 3 in FIG. 3.

TABLE 1

| No. | alloy composition(at %) | thermal coefficient of Br (%/°C.) | iHc(kOe) | Br(kG) | (BH) max (MGOe) |
|---|---|---|---|---|---|
| *1 | Fe-8B-15Nd | 0.14 | 11.4 | 12.3 | 34.0 |
| *2 | Fe-10Co-8B-15Nd | 0.09 | 10.6 | 11.9 | 33.1 |
| *3 | Fe-8B-14.2Nd-0.8Dy | 0.14 | 16.1 | 12.0 | 34.2 |
| *4 | Fe-10Co-14Nd-1Dy | — | 0 | 0 | 0 |
| *5 | Fe-10Co-10B-5Nd-1Dy | — | <5 | <5 | <5 |
| *6 | Fe-10Co-17B-28Nd-2Dy | — | 16.2 | 5.0 | <5 |
| 7 | Fe-10Co-8B-13.2Nd-0.8Dy | 0.09 | 14.4 | 11.8 | 34.0 |
| 8 | Fe-20Co-8B-13.2Nd-0.8Dy | 0.08 | 15.8 | 11.9 | 33.5 |
| 9 | Fe-30Co-8B-13.2Nd-0.8Dy | 0.07 | 10.8 | 11.7 | 32.2 |
| *10 | Fe-40Co-8B-13.2Nd-0.8Dy | 0.07 | 7.6 | 10.8 | 20.3 |
| 11 | Fe-5Co-8B-13.5Nd-1Dy | 0.10 | 14.8 | 12.0 | 33.8 |
| 12 | Fe-10Co-7B-7Pr-7Nd-2La-0.5Ho | 0.10 | 13.2 | 9.8 | 21.3 |
| 13 | Fe-10Co-7B-13Pr-2La-1Tb | 0.10 | 12.1 | 10.2 | 22.5 |
| 14 | Fe-10Co-7B-14Nd-1Gd-0.5Yb | 0.09 | 14.3 | 10.9 | 26.0 |

TABLE 2

| No. | alloy composition(at %) | iHc(kOe) | (BH)max (MGOe) |
|---|---|---|---|
| *1 | Fe-5Co-8B-15Nd | 11.1 | 33.4 |
| 2 | Fe-5Co-8B-14.8Nd-0.2Dy | 11.6 | 35.8 |
| 3 | Fe-5Co-8B-14.6Nd-0.4Dy | 12.0 | 37.2 |
| 4 | Fe-5Co-8B-14.2Nd-0.8Dy | 13.9 | 33.8 |
| 5 | Fe-5Co-8B-13.8Nd-1.2Dy | 14.9 | 31.9 |
| 6 | Fe-5Co-8B-13.5Nd-1.5Dy | 15.7 | 30.7 |
| 7 | Fe-5Co-8B-12Nd-3Dy | 16.8 | 29.4 |
| 8 | Fe-10Co-7B-13.5Nd-1.5Dy | 13.9 | 32.7 |
| 9 | Fe-20Co-7B-13.5Nd-1.5Dy | 12.2 | 29.0 |
| 10 | Fe-10Co-8B-14Nd-1Ho | 12.4 | 33.6 |
| 11 | Fe-10Co-8B-14Nd-1Gd | 11.4 | 31.8 |
| 12 | Fe-10Co-8B-14Nd-1Tb | 14.6 | 33.6 |
| 13 | Fe-10Co-8B-14Nd-1Er | 12.8 | 30.3 |
| 14 | Fe-10Co-8B-14Nd-1Yb | 11.6 | 34.1 |
| 15 | Fe-8Co-8B-14Pr-1Dy | 14.2 | 22.8 |
| 16 | Fe-10Co-11Nd-2La-1Dy-1Gd | 12.7 | 24.5 |

TABLE 3

| No. | alloy composition(at %) | iHc(kOe) | (BH)max (MGOe) |
|---|---|---|---|
| 1 | Fe-10Co-7B-13.5Nd-1.5Dy-1Nb | 12.8 | 34.5 |
| 2 | Fe-20Co-7B-13.5Nd-1.5Dy-1Nb | 11.1 | 30.5 |
| 3 | Fe-10Co-7B-13.5Nd-1.5Dy-4Nb | 12.2 | 26.8 |
| 4 | Fe-10Co-8B-13.5Nd-1.5Dy-1W | 13.9 | 32.2 |
| 5 | Fe-10Co-8B-13.5Nd-1.5Dy-1Al | 14.1 | 30.8 |
| 6 | Fe-10Co-8B-13.5Nd-1.5Dy-1Ti | 11.6 | 29.7 |
| 7 | Fe-10Co-8B-13.5Nd-1.5Dy-1V | 12.6 | 28.8 |
| 8 | Fe-10Co-8B-13.5Nd-1.5Dy-1Ta | 12.1 | 31.2 |
| 9 | Fe-10Co-8B-13.5Nd-1.5Dy-1Cr | 12.7 | 28.3 |
| 10 | Fe-10Co-8B-13.5Nd-1.5Dy-1Mo | 13.3 | 31.1 |
| 11 | Fe-10Co-8B-13.5Nd-1.5Dy-1Mn | 12.5 | 28.2 |
| 12 | Fe-10Co-8B-13.5Nd-1.5Dy-1Ni | 10.8 | 29.6 |
| 13 | Fe-10Co-8B-13.5Nd-1.5Dy-1Ge | 11.3 | 27.3 |
| 14 | Fe-10Co-8B-13.5Nd-1.5Dy-1Sn | 14.6 | 21.5 |
| 15 | Fe-10Co-8B-13.5Nd-1.5Dy-Sb | 10.1 | 22.4 |
| 16 | Fe-10Co-8B-13.5Nd-1.5Dy-1Bi | 11.8 | 27.5 |
| 17 | Fe-10Co-8B-13.5Nd-1.5Dy-1Zr | 10.8 | 28.6 |

TABLE 4

| | room temp. (22° C.) | | 100° C. | |
|---|---|---|---|---|
| | iHc(kOe) | (BH)max (MGOe) | iHc(kOe) | (BH)max (MGOe) |
| RCo(2-17type) magnet | 6.2 | 29.3 | 5.2 | 26.4 |
| Fe-8B-15Nd | 11.4 | 34.0 | 5.6 | 26.8 |

We claim:

1. A process for producing an (Fe, Co)—B—R permanent magnet alloy having a higher Curie temperature than a corresponding Fe—B—R alloy containing no Co, comprising:

providing a mixture of Fe, Co, B and R, R representing the sum of $R_1$ and $R_2$, wherein $R_1$ is at least one rare earth selected from the group consisting of Dy, Tb and Ho and $R_2$ consists of Nd and/or Pr, the proportions of the mixture being chosen such that the alloy consists essentially of, in atomic percent, 0.2 to 3% of $R_1$, 12.5 to 20% of R, 5 to 11% of B, and at least 69% Fe in which Co is substituted for Fe in an amount greater than zero and not exceeding 25% of the alloy;

melting the mixture and cooling the resulting melted mixture by casting the resulting mixture as an ingot under conditions such that at least 50% of the alloy becomes a tetragonal (Fe, Co)—B—$R_1$, $R_2$ crystal phase.

2. A process according to claim 1, further comprising a step of pulverizing the alloy after cooling.

3. A process according to claim 2, wherein the pulverizing is carried out so as to produce alloy particles in a particle size range of 0.3 to 80 microns.

4. A process for producing an (Fe, Co)—B—R—M permanent magnet alloy having a higher Curie temperature than a corresponding Fe—B—R—M alloy containing no Co, comprising:

providing a mixture of Fe, Co, B, R and M, R representing the sum of $R_1$ and $R_2$, wherein $R_1$ is at least one rare earth selected from the group consisting of Dy, Tb and Ho and $R_2$ consists of Nd and/or Pr, the proportions of the mixture being chosen such that the alloy consists essentially of, in atomic percent, 0.2 to 3% of $R_1$, 12.5 to 20% of R, 5 to 11% of B, at least 69% Fe in which Co is substituted for Fe in an amount greater than zero and not exceeding 25% of the alloy and at least one of additional elements M in amounts not more than the atomic percentages specified as:

| | | | | | |
|---|---|---|---|---|---|
| 3% | Ti, | 3.3% | Zr, | 3.3% | Hf, |
| 4.5% | Cr, | 5% | Mn, | 6% | Ni, |
| 7% | Ta, | 3.5% | Ge, | 1.5% | Sn, |
| 1% | Sb, | 5% | Bi, | 5.2% | Mo, |
| 9% | Nb, | 5% | Al, | 5.5% | V, and |
| 5% | W; | | | | |

melting the mixture and cooling the resulting melted mixture by casting the resulting mixture as an ingot under conditions such that at least 50% of the alloy becomes a tetragonal (Fe, Co)—B—$R_1$, $R_2$ crystal phase.

5. A process according to claim 4, further comprising a step of pulverizing the alloy after cooling.

6. A process according to claim 5, wherein the pulverizing is carried out so as to produce alloy particles in a particle size range of 0.3 to 80 microns.

* * * * *